United States Patent [19]

Kassis

[11] Patent Number: 4,692,956

[45] Date of Patent: Sep. 15, 1987

[54] POOL VACUUM

[76] Inventor: Amin I. Kassis, 57 Stockdale Rd., Needham, Mass. 02192

[21] Appl. No.: 815,214

[22] Filed: Dec. 31, 1985

[51] Int. Cl.[4] ..... E04H 3/20

[52] U.S. Cl. ..... 15/1.7; 15/387

[58] Field of Search ..... 15/1.7, 387

[56] References Cited

U.S. PATENT DOCUMENTS

| | | | |
|---|---|---|---|
| 2,063,253 | 12/1936 | Kuhnel | 15/387 X |
| 2,703,904 | 3/1955 | De Long | 15/387 X |
| 3,008,159 | 11/1961 | Del Vecchio | 15/1.7 |
| 3,444,575 | 5/1959 | Martin | 15/1.7 |
| 3,909,875 | 10/1975 | Rother et al. | 15/387 |
| 3,949,442 | 4/1976 | Chandler | 15/1.7 |
| 3,961,393 | 7/1976 | Pansini | 15/1.7 |
| 4,018,483 | 4/1977 | Smith | 15/1.7 |
| 4,254,525 | 3/1981 | Combest | 15/1.7 |
| 4,338,697 | 7/1982 | Broadwater | 15/1.7 |
| 4,498,206 | 2/1985 | Braukmann | 15/1.7 |
| 4,554,702 | 11/1985 | Kochte et al. | 15/387 X |

FOREIGN PATENT DOCUMENTS

| | | | |
|---|---|---|---|
| 299281 | 11/1954 | Switzerland | 15/387 |

*Primary Examiner*—Edward L. Roberts

[57] ABSTRACT

A device for removing foreign matter from a water-filled pool comprising a vacuum head equipped with a conduit connectable between suction means and a chamber-defining housing, and at least one agitation member rotatably connected to the inside of said chamber in position to be rotated by fluid suctioned from said chamber into said conduit such that turbulance caused by said rotation may dislodge fine particulate material from a pool surface.

12 Claims, 7 Drawing Figures

POOL VACUUM

BACKGROUND OF THE INVENTION

This invention relates to swimming pool vacuum cleaners.

Debris in swimming pool water, including fine particulate matter settled on the bottom of a pool, is conventionally removed by vacuum suction. Turbulence introduced by vacuum action tends to resuspend the fine particulate material in the pool water, dispersing it so that it is removed from the suction area of the vacuum apparatus and causing the pool water to become cloudy. Chandler, U.S. Pat. No. 3,949,442 and Broadwater, U.S. Pat. No. 4,338,697 disclose pool vacuums designed to avoid turbulence.

Pansini, U.S. Pat. No. 3,961,393, and Martin, U.S. Pat. No. 3,444,575 disclose pool vacuum heads incorporating water pump systems for creating an upwardly ascending vortex within the confines of the head unit to assist in capturing the fine particulate material before it can become dispersed and resuspended in the pool water; Smith, U.S. Pat. No. 4,018,483, discloses a directed pressure flow inlet and return system to dislodge dirt; and Combest, U.S. Pat. No. 4,254,525 discloses brush elements that work in conjunction with a rib structure to create a vortex that increases scrubbing water flow.

SUMMARY OF THE INVENTION

In general the invention features a device for removing foreign matter from a water-filled pool comprising a vacuum head equipped with a conduit connectable between suction means and a chamber-defining housing, and at least one agitation member rotatably connected to the inside of the chamber in position to be rotated by fluid suctioned from the chamber into the conduit, such that turbulence caused by the rotation dislodges fine particulate material from a pool surface.

In preferred embodiments, the agitator member is an elongated blade attached to the inside of the chamber by an axial shaft to rotate in a generally horizontal plane, the blade having fluid-deflecting surfaces pitched with respect to the shaft axis. Bristles are attached to the downward facing surfaces of the agitation member(s) and the vacuum head housing to dislodge particles from the pool surfaces and to contain particles within the chamber; and the head includes a partition member in the housing to define inner and outer chamber portions, the partition being supported from the housing by a plurality of narrow struts and having at least one port to communicate suction between the inner and outer chamber. The port(s) are adapted to receive removable agitator member(s) to rotate freely therewithin and to enhance turbulence in the vicinity of the ports. Agitator member(s) can optionally be dismounted and replaced with cover(s) to block the flow of water through a given port(s).

Alternately, the partition is supported from the housing to allow the partition to move vertically between an upper position, in which the partition seals against the housing to block liquid flow from the outer chamber to the conduit, and a lower position, in which the partition is spaced from the outer chamber to allow liquid flow from the outer chamber to the conduit. The partition support is resiliently biased toward the lower position, vertical partition movement to the upper position occurring in response to downward pressure on the vacuum head. A flange extends downwardly from the housing to sealingly co-operate with a peripheral groove in the partition when the partition is in its upper position, and the ports are equipped with resiliently hinged covers which cover the ports when the partition is in its lower position, and which pivot about the hinge to uncover the ports when the partition is in its upper position.

Turbulence created by rotation of the water current-driven agitator member(s) is localized within the vacuum head housing, preventing suspended particles from escaping the influence of the vacuum and mixing with pool water outside the vacuum head. This turbulence additionally tends to impede uniform channeling of water currents, distributing the effects of suction more evenly over the pool surface area defined by the vacuum chamber perimeter.

DESCRIPTION OF THE PREFERRED EMBODIMENTS

I first briefly describe the drawings.

DRAWINGS

STRUCTURE

Figure 1:
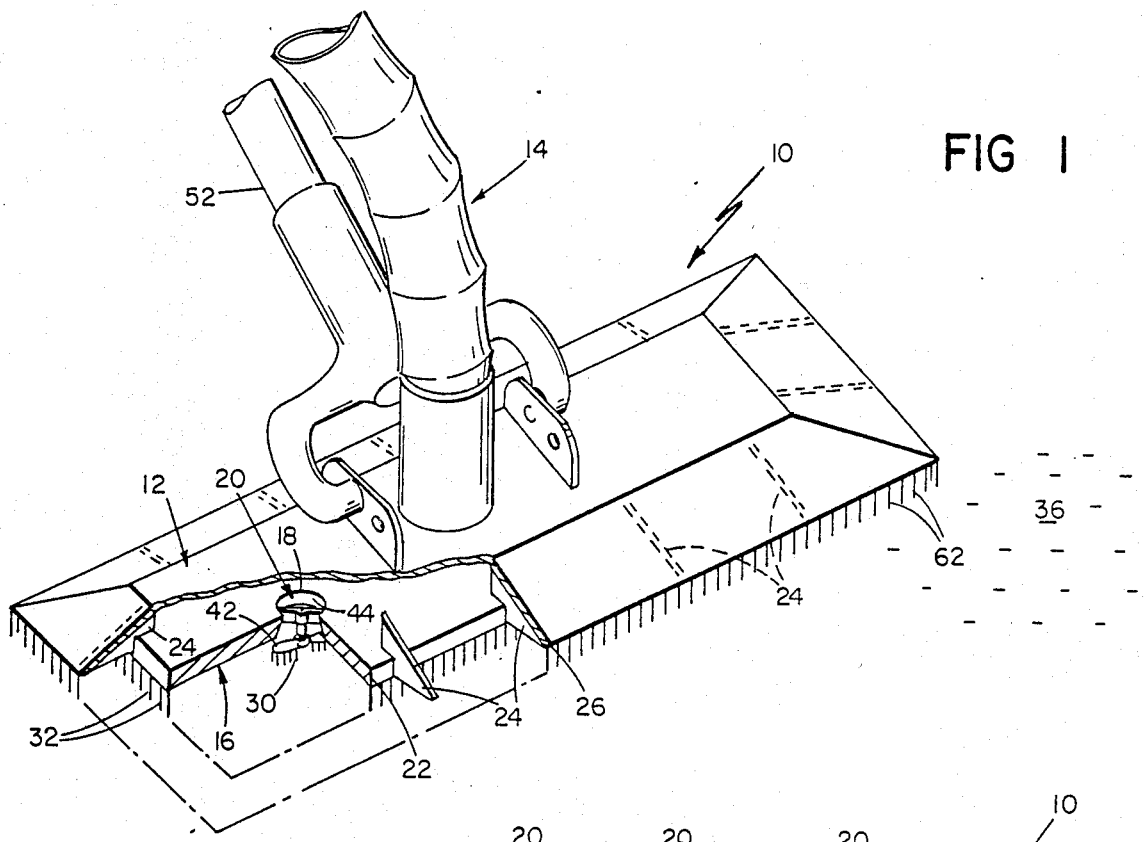
FIG. 1 is a perspective view of a pool vacuum head partially broken away.

Referring to FIG. 1, swimming pool vacuum cleaner head 10 rests on a pool floor surface 36, and comprises a housing 12 that defines a suction chamber in communication with a suction tube conduit 14. Extension handle 52 is pivotally attached to the outside of housing 12. Within the chamber is a partition 16 having a plurality of (e.g., three) ports 18 whose angled walls 44 define a conical profile in partition 16. Each port 18 houses a shaft-mounted agitator member 20 designed to rotate freely in either direction. The agitator member 20 is driven solely by water flow, without any independent power source.

Housing 12, similar in shape to that of inner partition 16, is somewhat larger overall, such that partition 16 nests inside it with sufficient clearance that water under influence of the suction applied to conduit 14 may pass freely between the two. Thus, partition 16 forms an inner chamber (between the partition and the pool floor) and an outer chamber (between the partition and the housing) within housing 12.

Partition perimeter 22, as well as the bottom edge 26 of housing 12, are rimmed by rows of stiff bristles 32, 62 which aid in loosening fine particulate material from the surface 36 of the pool floor, and whose tips contact surface 36 to serve as support means for the cleaner head 10. Spacing between individual bristles 32, 62 is sufficiently narrow to impose a confining effect on water turbulence created within the perimeter of operating vacuum head housing 12, and yet is sufficiently wide to allow suctioned water to flow through the inner chamber, the outer chamber, or both before exiting the pool via conduit 14.

Figure 2:
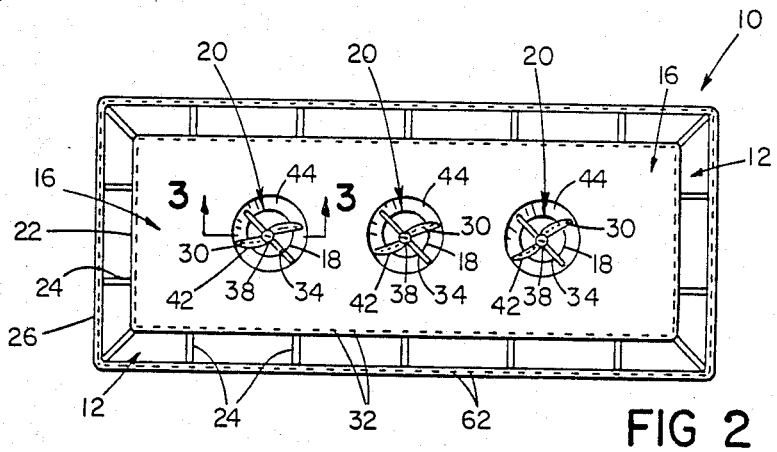
FIG. 2 is a plan view of a pool vacuum head from below.

Referring to FIG. 2, partition 16 is supported by and separated from housing 12 by a plurality of bridging struts 24 which extend between the outer edge of perimeter 22 and the inner wall of downwardly slanted edge 26 of the housing 12.

Figure 3:
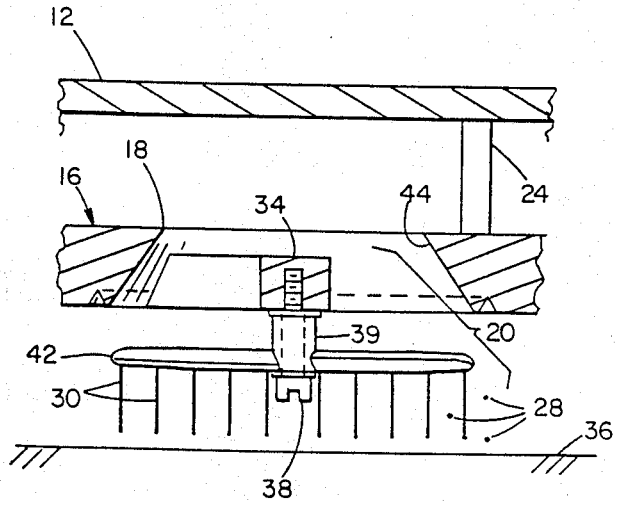
FIG. 3 is a detailed view of an agitator member for the vacuum head shown in FIGS. 1 and 2, partially in section.

Referring to FIG. 3, an agitation blade member 20 turning under the influence of vacuum suction creates turbulance in its vicinity which disturbs fine particulate material 28 and entrains material 28 in the water flowing from the pool via ports 18 and suction conduit 14. Optionally, the downward facing surface of each member 20 is provided with a row of fine scrubbing bristles 30 for dislodging particulate material from the pool floor surface 36, and for contributing to localized turbulance. These bristles 30 terminate slightly above the surface 36 to be cleaned such that contact with the pool floor surface 36 is made only when the user exerts downward pressure on the head 10, causing the partition/housing bristles 32, 62 to flex. Bristles 30 are sufficiently flexible to permit continued rotation of agitation member 20 even when light contact with surface 36 is made, i.e., the bristles 30 readily flex rather than produce increased friction with pool surface 36. Agitator member 20 comprises a central hub 39 mounted on a screw 38, a mounting bracket 34, and a pair of radiating blades 42 which are placed equidistant and axially about hub 39, and twisted so that each blade 42 forms part of a helical surface that is pitched with respect to the shaft axis.

Figure 4:
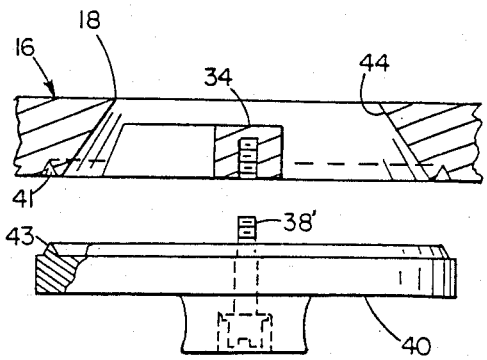
FIG. 4 is a detailed view of a port plug, partially in section.

Agitation member(s) 20 can optionally be removed from vacuum head 10 and replaced with port cover(s) 40, shown in FIG. 4, mounted by a screw 38, thereby eliminating flow of suctioned water through port(s) 18. Annular flange 43 extending from the upper surface of cover 40 mates with a corresponding groove 41 peripheral to each port 18 on the underside of partition 16 to facilitate sealing and to concentrically align each cover 40 with each port 18.

Use

In use, suction conduit 14 is coupled to an external vacuum source, and head 10 is submerged in a water-filled pool to rest on the floor 36 of the pool below water level. Vacuum head 10 is made to move along surface 36 by means of lateral pressure exerted by the user on handle 52. Downwardly extending bristles 32, 62 contact surface 36 with their tips and provide a means of support for vacuum head 10, as well as a scrubbing action effecting removal of material adhered to or settled onto the wall's surface. Vacuum applied to suction conduit 14 causes water surrounding head 10 to flow between each of the bristles 32, 62 into the area defined by projecting lip 26 of casing 12, where it exits the pool via conduit 14. The water flowing under the influence of the applied vacuum causes agitator members 20 to rotate creating a sphere of turbulence which is confined by projecting bristles 32 adjacent to the pool floor surface. Particulate material 28 loosened by this action is drawn by the current into conduit 14 via ports 18 and thereby removed from the pool. Absent such rotation, the water flow adjacent partition 16 would assume paths of least resistance that generally comprises narrow current pathways across the pool surface 36 into ports 18, leaving particulate material undisturbed on the areas of surface 36 not contacted by the currents.

ALTERNATE EMBODIMENT

Figure 5:
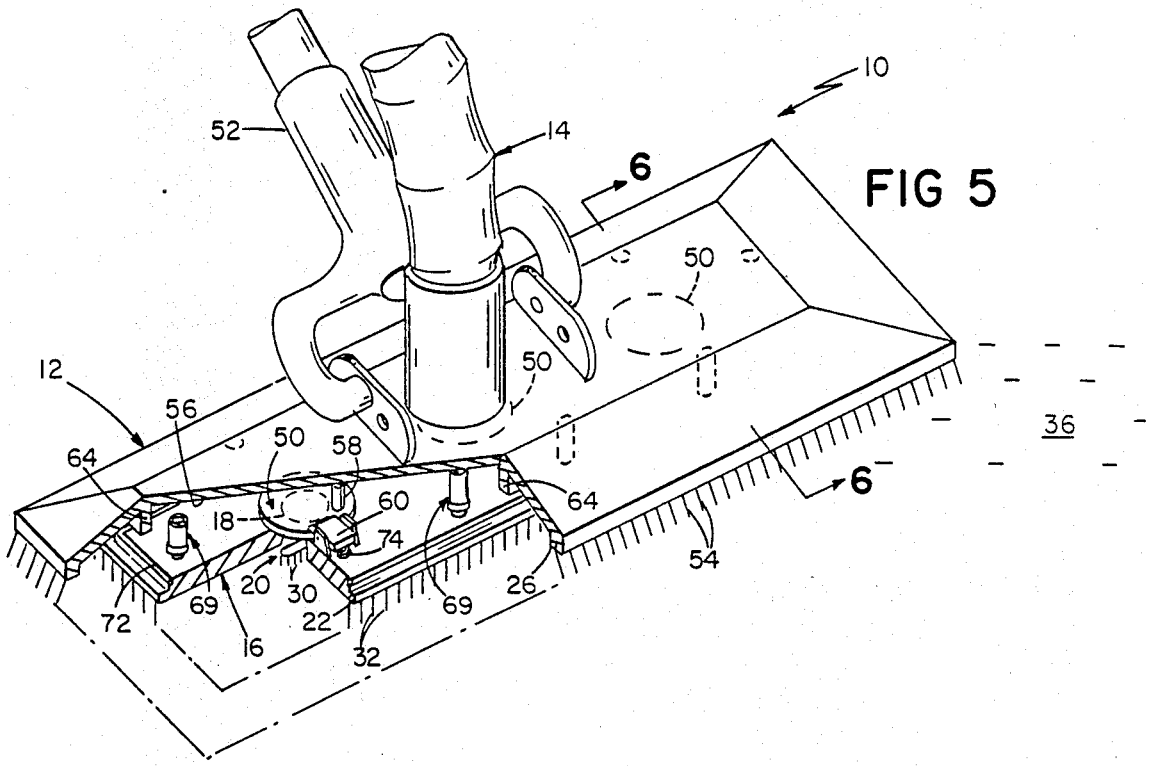
FIG. 5 is a perspective view of an alternate embodiment of a pool vacuum head partially broken away.
Figure 6A:
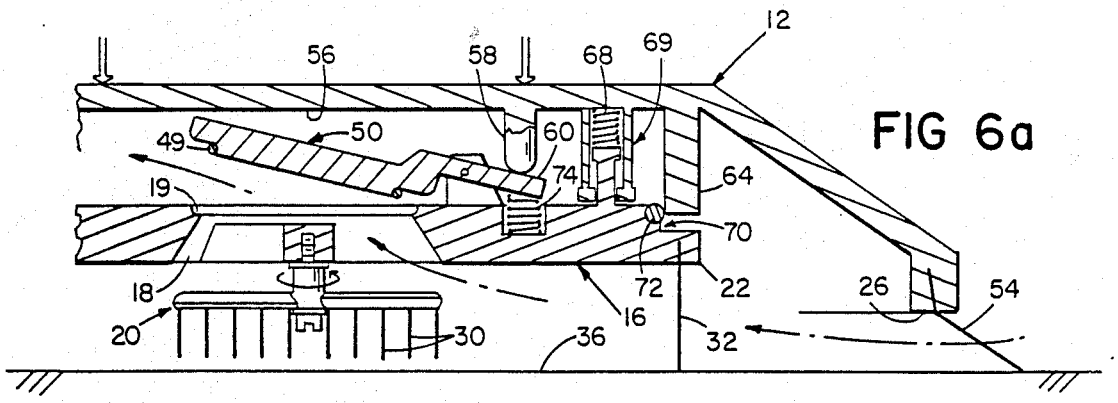
FIG. 6A and 6B are cross-sectional views of FIG. 5 taken along 6—6.
Figure 6B:
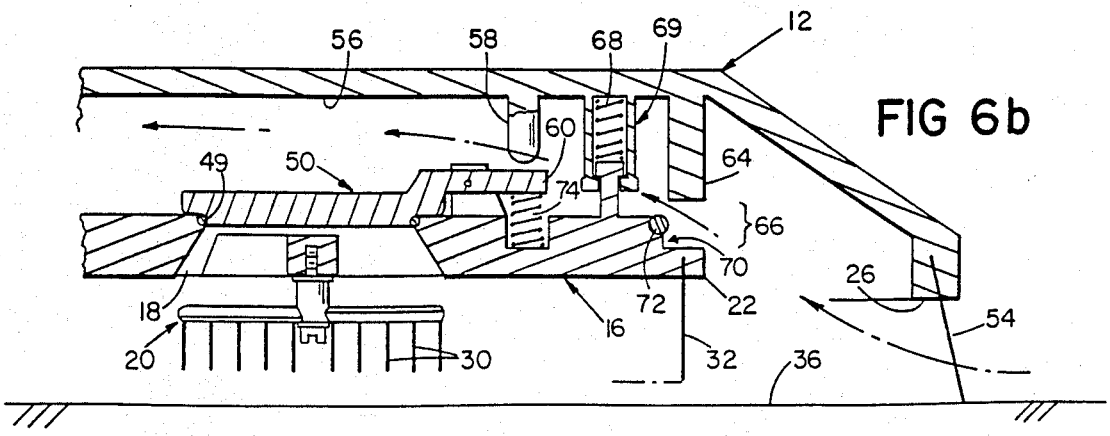

An alternate embodiment shown in FIGS. 5, 6A, and 6B, has the features of the preferred embodiment except for the modifications described below which serve to direct water flow to selected regions within vacuum head 10. Partition 16 is suspended from the inner surface 56 of outer chamber 12 by tension members 69; stiff bristles 62 are replaced by angled springy bristles 54; ports 18 are fitted with hinged covers 50; and the inner surface 56 of housing 12 is fitted with projections 58 and barrier rim 64.

In the alternate embodiment, suctioned water flow is alternately directed either in a path through ports 18, or in a path between partition 16 and housing 12, but is unable to flow in both paths simultaneously. Vacuum head 10 resting on surface 36 is supported by springy bristles 54, which are sufficiently long to prevent contact of partition bristles 32 with surface 36 in the absence of downward force. In response to lateral forces applied by user to move head 10 over surface 36, bristles 54 flex somewhat, but not enough to allow bristles 32 to contact surface 36. Under these conditions, spring-loaded covers 50 are closed, and suctioned water flows through the region 66 defined by partition 16, and inner surface 56 of housing 12. However, when scrubbing action is desired, downward pressure exerted by the user simultaneous with applied lateral forces, causes bristles 54 to bend substantially whereby bristles 32 firmly contact surface 36. Bristles 32 resist bending under sustained downward pressure, and thus transfer the applied force via partition 16 to tension members 69 whose resilient springs 68 readily compress.

Compression of springs 68 enables barrier 64 to mate with recess 70 and projections 58 to contact tabs 60 at the same moment, overcoming the opposing force provided by springs 74 and resulting in the opening of ports 18 and the diversion of suctioned water from region 66 to flow through ports 18. Recess 70 is provided an O-ring 72 to facilitate a seal with barrier 64. The underside of cover 50 is adapted to receive an O-ring 49 positioned to contact the upper edge of port 18 which is recessed with a semi-circular groove 19 in which O-ring 49 is seated when cover 50 is in the closed position. In the absence of active scrubbing, bristles 32 have no contact with surface 36 and springs 68 and 74 respectively provide sufficient resilience to separate barrier 64 from recess 70 and to maintain covers 50 in position blocking ports 18, providing flow of suctioned water exclusively through region 66. By restricting the area through which suctioned water may pass, an increase in relative suction is achieved over that of the preferred embodiment, in which flow of suctioned water is unrestricted.

The above described description provides specific features of one vacuum head according to the invention. A description of general features of a vacuum head is provided in Braukmann, U.S. Pat. No. 4,498,206 which is hereby incorporated by reference.

Other features and embodiments are within the following claims.

What is claimed is:

1. A device for removing foreign matter from a water-filled pool, comprising:

a vacuum head having a chamber-defining housing, and a conduit communicating with said housing, said conduit being connectable to a suction means;

a plurality of agitator members comprising an elongated blade rotatably attached to an axial shaft and having fluid deflecting surfaces pitched with respect to said shaft axis, said agitataor members being rotatably connected to the inside of said housing in position above the pool surface to be rotated by fluid suctioned from said housing into said conduit, rotation of said agitator members causing turbulence to dislodge fine particulate matter from a pool surface, a partition member positioned within said housing to define inner and outer chamber portions, a plurality of support means supporting said partition member from said housing; and a plurality of ports in said partition member communicating suction between said inner and outer chamber portions, each said agitator member being positioned within a said port.

2. The device of claim 1, said agitator members being attached to the inside of said housing to rotate in a generally horizontal plane.

3. The device of claim 1, said support means comprising narrow struts.

4. The device of claim 1, comprising rows of bristles positioned on downward-facing peripheral surfaces of said housing to dislodge particles from pool surfaces and to contain particles within the housing.

5. The device of claim 1, said agitator members being situated to rotate freely within said ports.

6. The device of claim 1, comprising rows of scrubbing bristles extending downwardly from said agitator members.

7. The device of claim 1 where said agitator rotation is entirely driven by said fluid suction, without the application of other external energy sources.

8. The device of claim 1 further comprising means to removably attach at least one of said agitator members to one of said ports, and a removable cover adapted to cooperate with said agitator member attachment means when said at least one agitator member is removed, said cover being sized and adapted to block said one of said ports.

9. A device for removing foreign matter from a water-filled pool, comprising:

a vacuum head having a chamber-defining housing, and a conduit communicating with said housing, said conduit being connectable to a suction means;

at least one agitator member rotatably connected to the inside of said housing in position to be rotated by fluid suctioned from said housing into said conduit, said member rotation causing turbulence to dislodge fine particulate matter from a pool surface, a partition member positioned within said housing to define inner and outer chamber portions, a plurality of support means supporting said partition member from said housing, a plurality of ports in said partition member communicating suction between said inner and outer chamber portions, and means to support said partition from said housing and to allow vertical partition movement between an upper position in which said partition seals against said housing to block liquid flow from said outer chamber portion to said conduit, and a lower position in which said partition is spaced from said housing to allow liquid flow from said outer chamber portion to said conduit, said device comprising means to resiliently bias said partition in said second position and to allow said movement in response to downward pressure on said vacuum head.

10. The device of claim 9 further comprising means to removably attach said agitator member to said port, and a removable cover adapted to co-operate with said agitator member attachment means when said agitator member is removed, said cover being sized and adapted to block said port.

11. The device of claim 9, said housing comprising a downwardly extending peripheral flange positioned to sealingly co-operate with a peripheral groove in said partition, when said partition is in said upper position.

12. The device of claim 9 further comprising a cover plate for said port, said plate being resiliently hinged to cover said port when said partition is in said lower position and said device comprising means pivot said cover on said hinge to uncover said port when said partition is in said upper position.

* * * * *